US012496678B2

(12) United States Patent
Murakami et al.

(10) Patent No.: US 12,496,678 B2
(45) Date of Patent: Dec. 16, 2025

(54) METHOD OF POLISHING SILICON WAFER AND METHOD OF PRODUCING SILICON WAFER

(71) Applicant: SUMCO CORPORATION, Tokyo (JP)

(72) Inventors: Masahiro Murakami, Tokyo (JP); Ryoya Terakawa, Tokyo (JP)

(73) Assignee: SUMCO CORPORATION, Tokyo (JP)

( * ) Notice: Subject to any disclaimer, the term of this patent is extended or adjusted under 35 U.S.C. 154(b) by 420 days.

(21) Appl. No.: 18/257,492

(22) PCT Filed: Aug. 25, 2021

(86) PCT No.: PCT/JP2021/031247

§ 371 (c)(1),
(2) Date: Jun. 14, 2023

(87) PCT Pub. No.: WO2022/130696

PCT Pub. Date: Jun. 23, 2022

(65) Prior Publication Data

US 2024/0025008 A1 Jan. 25, 2024

(30) Foreign Application Priority Data

Dec. 16, 2020 (JP) ..... 2020-208282

(51) Int. Cl.
*B24B 37/04* (2012.01)
*B24B 53/017* (2012.01)

(52) U.S. Cl.
CPC ..... *B24B 37/042* (2013.01); *B24B 53/017* (2013.01)

(58) Field of Classification Search
CPC ..... B24B 37/005; B24B 37/04; B24B 37/042; B24B 37/10; B24B 37/102; B24B 37/105; B24B 57/02; B24B 7/228
See application file for complete search history.

(56) References Cited

U.S. PATENT DOCUMENTS

2013/0095660 A1 4/2013 Tanimoto et al.
2020/0306922 A1* 10/2020 Matsuda ..... B24B 37/10

FOREIGN PATENT DOCUMENTS

CN 110800085 A 2/2020
JP 11-243072 9/1999

(Continued)

OTHER PUBLICATIONS

International Search Report issued in International Patent Application No. PCT/JP2021/031247, dated Nov. 30, 2021, along with an English translation thereof.

(Continued)

*Primary Examiner* — C. A. Rivera
(74) *Attorney, Agent, or Firm* — GREENBLUM & BERNSTEIN, P.L.C.

(57) ABSTRACT

A method of polishing a silicon wafer, including a final polishing step including a pre-stage polishing step and a subsequent finish polishing step. The finish polishing step in the final polishing step includes a finish slurry polishing step using a polishing solution having an abrasive grain density of $1\times10^{13}/cm^3$ or more as the second polishing solution; and a pre-polishing step using a polishing solution having an abrasive grain density of $1\times10^{10}/cm^3$ or less as the second polishing solution, the pre-polishing step being performed prior to the finish slurry polishing step. A method of producing a silicon wafer, including the steps of: forming a notch portion on a periphery of a single crystal silicon ingot grown by the Czochralski process; slicing the ingot to obtain a silicon wafer; and subjecting the resulting silicon wafer to the above method of polishing a silicon wafer.

6 Claims, 3 Drawing Sheets

(56) References Cited

FOREIGN PATENT DOCUMENTS

| | | |
|---|---|---|
| JP | 2003-311593 | 11/2003 |
| JP | 2007-103703 | 4/2007 |
| JP | 2015-159259 | 9/2015 |
| JP | 2017-183478 | 10/2017 |
| JP | 2019-110233 | 7/2019 |
| KR | 10-2017-0113539 | 10/2017 |
| KR | 10-2019-0103422 | 9/2019 |
| KR | 10-2020-0031606 | 3/2020 |
| WO | 2012/002525 | 5/2012 |

OTHER PUBLICATIONS

International Preliminary Report on Patentability issued in International Patent Application No. PCT/JP2021/031247, dated Jun. 13, 2023, along with an English translation thereof.
First Office Action issued in Corresponding Chinese Patent Application No. 202180085438.2, dated Jul. 18, 2025, along with an English translation thereof.
Office Action issued in Corresponding KR Patent Application No. 10-2023-7012030, dated May 30, 2024, along with an English translation thereof.
Decision on Rejection issued in corresponding Chinese Patent Application No. 202180085438.2, dated Oct. 13, 2025, along with an English translation thereof.

* cited by examiner

METHOD OF POLISHING SILICON WAFER AND METHOD OF PRODUCING SILICON WAFER

TECHNICAL FIELD

This disclosure relates to a method of polishing a silicon wafer and a method of producing a silicon wafer

BACKGROUND

A process for producing a silicon wafer mainly includes a single crystal pulling step for forming a single crystal ingot and a step of processing the formed single crystal ingot. This processing step typically includes a slicing step, a lapping step, a beveling step, an etching step, a mirror polishing step, a cleaning step, and others; and through these steps, a silicon wafer having a mirror-finished surface is produced.

In the mirror polishing step, polishing is performed in multiple stages of, for example, a double-side polishing step (lapping step) of simultaneously polishing both sides of a silicon wafer, followed by a final polishing step of mirror-finishing one side of the silicon wafer. The final polishing step is usually performed using a polishing unit including a plate provided with a polishing pad on its surface, and a polishing head holding a silicon wafer. One side of a silicon wafer held on the polishing head is pressed against the polishing pad, and the polishing head and the plate are rotated at the same time while supplying, to the polishing pad, a polishing solution (polishing slurry) which is an alkaline aqueous solution containing abrasive grains. Thus, one side of the silicon wafer is made to be a mirror-like surface having excellent smoothness by polishing using mechanochemical polishing (i.e., chemical mechanical polishing: CMP) in which the mechanical polishing action of abrasive grains and the chemical polishing action of the alkaline aqueous solution are combined.

In the final polishing step, polishing in two or more stages, including one or more upstream polishing steps performed using one or more upstream polishing units and a finish polishing step subsequently performed using a finish polishing unit.

Now, JP H11-243072 (PTL 1) and JP 2007-103703 (PTL 2) describe that polishing using a rinsing liquid is performed after slurry polishing in a final polishing step. Such techniques can inhibit abrasive grains of a polishing slurry from being accumulated on a polishing head.

CITATION LIST

Patent Literature

PTL 1: JP H11-243072 A
PTL 2: JP 2007-103703 A

SUMMARY

Technical Problem

However, the technique of PTL 1 had problems as described below. In PTL 1, ultrapure water is used as a rinsing liquid; however, when a polishing solution in the form of a slurry left on a polishing pad is diluted with ultrapure water, the pH of the polishing solution decreases to around neutrality, thus the abrasive grains cannot keep being dispersed and becomes aggregated and they also become easily deposited and left on a silicon wafer. The abrasive grains aggregated in the polishing solution act with a surface of the silicon wafer due to the reduction in pH to around neutrality, which adversely causes micro scratches, damages, and the like on the surface of the silicon wafer. Further, when the abrasive grains are left on the silicon wafer surface, pits would be formed in the silicon wafer surface in a cleaning step after the silicon wafer is removed from a polishing apparatus.

Further, in the technique of PTL 2, polishing using a rinsing liquid is performed after slurry polishing in a upstream polishing step; although the accumulation of abrasive grains of a slurry on the polishing head used for the upstream polishing can be inhibited, no sufficient measures are taken to prevent the formation of flaws and the like in the silicon wafer surface in the finish polishing step, which can result in the formation of light point defects (LPDs) for example due to particles deposited during transferring between polishing units and to slurry residue adhering to the finish polishing head.

It could therefore be useful to provide a method of polishing a silicon wafer and a method of producing a silicon wafer that can inhibit the formation of LPDs.

Solution to Problem

This disclosure primarily includes the following features.

(1) A method of polishing a silicon wafer, comprising a final polishing step including:

an upstream polishing step, using an upstream polishing unit including a first plate provided with a first polishing pad on its surface and a first polishing head, of polishing a surface of a silicon wafer by rotating the first plate and the silicon wafer held by the first polishing head with the silicon wafer being attached to the first polishing pad while supplying a first polishing agent to the first polishing pad; and a subsequent finish polishing step, using a finish polishing unit including a second plate provided with a second polishing pad on its surface and a second polishing head, of further polishing the surface of the silicon wafer by rotating the second plate and the silicon wafer held by the second polishing head with the silicon wafer being attached to the second polishing pad while supplying a second polishing agent to the second polishing pad, wherein the finish polishing step in the final polishing step includes:

a finish slurry polishing step using a polishing solution having an abrasive grain density of $1\times10^{13}/cm^3$ or more as the second polishing solution; and a pre-polishing step using a polishing solution having an abrasive grain density of $1\times10^{10}/cm^3$ or less as the second polishing solution, the pre-polishing step being performed prior to the finish slurry polishing step.

Here, "polishing solution having an abrasive grain density of $1\times10^{10}/cm^3$ or less as the second polishing solution" includes a polishing solution free of abrasive grains, such as pure water.

(2) The method of polishing a silicon wafer, according to (1) above, wherein the second polishing solution used in the pre-polishing step is pure water.

(3) The method of polishing a silicon wafer, according to (1) or (2) above, wherein the pre-polishing step is performed for 10 s to 60 s.

(4) The method of polishing a silicon wafer, according to any one of (1) to (3) above, wherein the rotational speed of the second polishing head in the pre-polishing step is higher than the rotational speed of the second polishing head in the finish slurry polishing step.

(5) The method of polishing a silicon wafer, according to (4) above, wherein the rotational speed of the second polishing head in the pre-polishing step is equal to or higher than 1.5 times the rotational speed of the second polishing head in the finish slurry polishing step.

(6) A method of producing a silicon wafer, comprising the steps of: slicing a single crystal silicon ingot grown by the Czochralski process to obtain a silicon wafer to be polished; and then subjecting the resulting silicon wafer to be polished to the method of polishing a silicon wafer, according to any one of (1) to (5) above.

Advantageous Effect

This disclosure can provide a method of polishing a silicon wafer and a method of producing a silicon wafer that can inhibit the formation of LPDs.

DETAILED DESCRIPTION

Embodiments of a method of polishing a silicon wafer and a method of producing a silicon wafer, according to this disclosure will now be described in detail with reference to the drawings.

(Method of Polishing Silicon Wafer)

Figure 1:
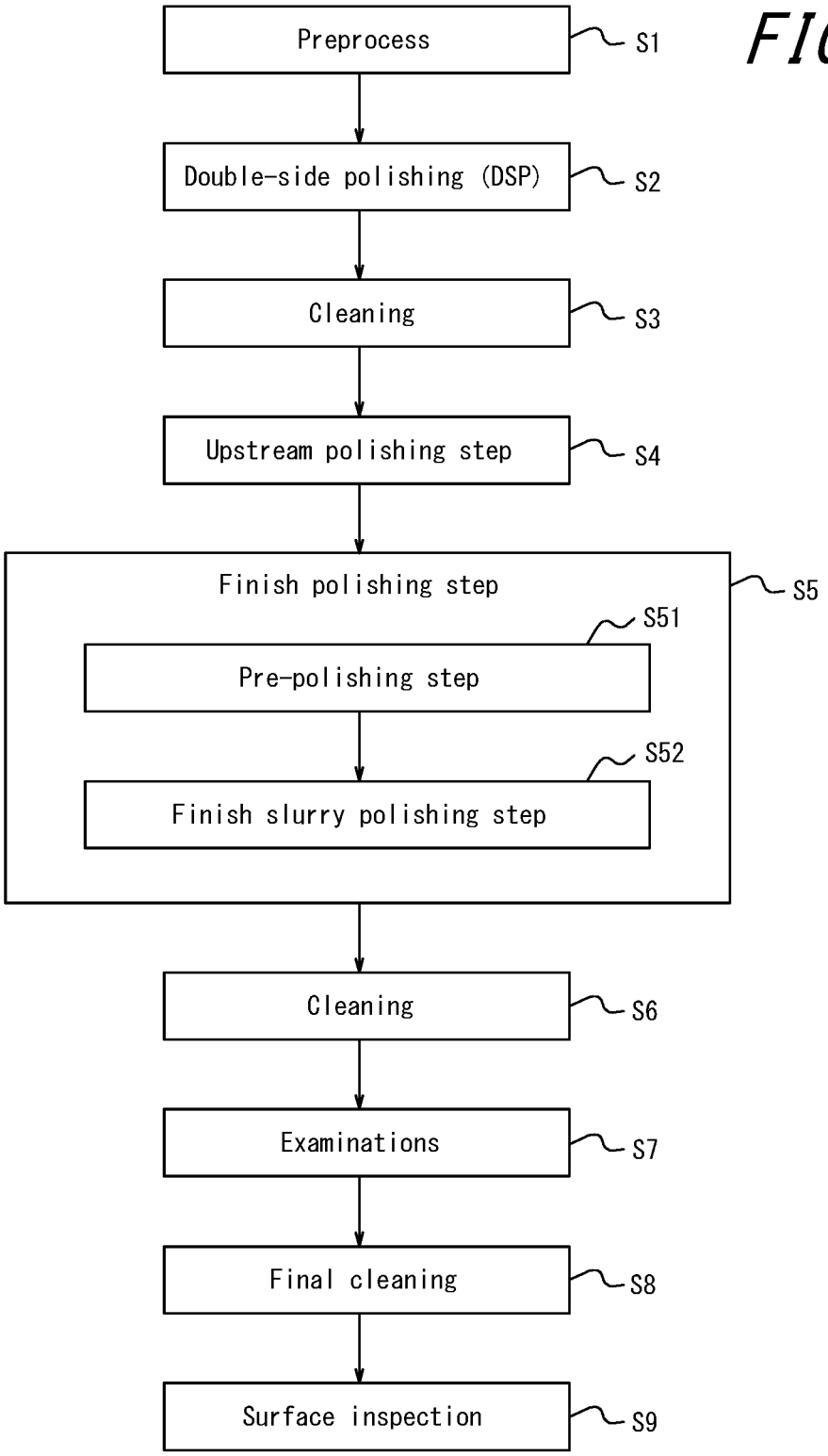
FIG. 1 is a flow diagram illustrating the steps of producing a silicon wafer, including a method of polishing a silicon wafer, according to one embodiment of this disclosure.
Figure 2:
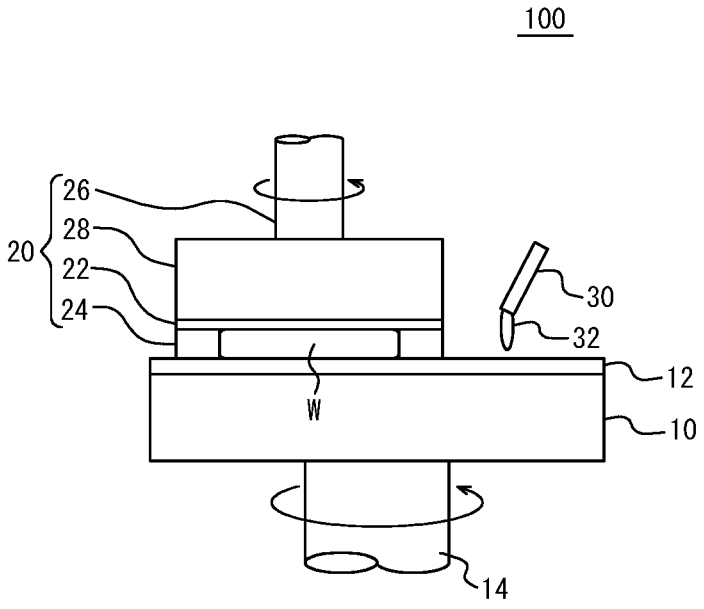
FIG. 2 is a schematic view illustrating a single-side polishing apparatus used in a finish polishing step in a method of polishing a silicon wafer, according to one embodiment of this disclosure.

FIG. 1 is a flow diagram illustrating the steps of producing a silicon wafer, including a method of polishing a silicon wafer, according to one embodiment of this disclosure. FIG. 2 is a schematic view illustrating a single-side polishing apparatus used in a finish polishing step in a method of polishing a silicon wafer, according to one embodiment of this disclosure.

In the preprocess (step S1) given in FIG. 1, a slicing step, a lapping step, a chamfering step, an etching step, and others are performed.

Subsequently, in double-side polishing (DSP step)(step S2), the shape of the silicon wafer is formed.

Next, the silicon wafer having been double-side polished is subjected to a cleaning step (step S3).

Since these steps S1 to S3 can be performed in the like manner as in existing techniques, they are not described in detail.

Subsequently, the silicon wafer having been cleaned is subjected to a final polishing step consisting of a upstream polishing step (step S4) and a finish polishing step (step S5). The upstream polishing step may include a plurality of stages; further, the finish polishing step includes a plurality of stages as descried below.

The upstream polishing step S4 can be performed by an existing technique; specifically, a surface of the silicon wafer is polished by while supplying a first polishing solution to a first polishing pad using a polishing unit including a first plate having a surface provided with a first polishing pad and a first polishing head, rotating the first plate and the silicon wafer with the silicon wafer held by the first polishing head being attached to the first polishing pad. The structure of the polishing unit used for the upstream polishing may be, by way of example, one the same as the polishing unit used for finish polishing to be described.

The finish polishing step (step S5) will be described in detail below.

The silicon wafer having been subjected to the final polishing step is subjected to examinations (step S7) after cleaning after the finish polishing step (step S5), thus observing the silicon wafer for its flatness; the presence or absence of visible flaws and stains; and others.

After that, the silicon wafer is subjected to a final cleaning step (step S8), and is later shipped after being subjected to a surface inspection (step S9).

Since steps S7 to S9 can be performed in the like manner as in existing techniques, they are not described in detail.

The finish polishing step (step S5) in the final polishing step in the above process will now be described in detail. First, referring to FIG. 2, a single-side polishing apparatus used in a method of polishing a silicon wafer, according to one embodiment of this disclosure is described. A single-side polishing apparatus 100 includes a rotating plate 10 to which a polishing pad 12 for polishing one of the surfaces of a silicon wafer W is attached; a polishing head 20 that is placed to face the rotating plate 10 and includes a backing pad 22 that form a retaining surface for holding the other surface of the silicon wafer W and a retainer ring 24 attached to the outer edge of the retaining surface of the backing pad 22; and a slurry supply 30 supplying a polishing slurry 32 onto the polishing pad 12. The polishing slurry 32 may contain abrasive grains and an etching agent. The retainer ring 24 may be configured to have an inner diameter that is substantially equal to or more than the diameter of the silicon wafer W.

Further, the polishing head 20 may include a shaft 26 lifting or lowering and rotating the polishing head 20; and a rotation frame 28 that is provided at the lower end of the shaft 26 and is provided with the backing pad 22 on its lower surface. Further, the single-side polishing apparatus 100 may include a plate rotating shaft 14 that is connected to the rotating plate 10 and rotates the rotating plate 10. The shaft 26 and the plate rotating shaft 14 may be connected to a driving mechanism (not shown) such as a motor.

In the finish polishing step (step S5), after the upstream polishing step (step S4), using a finish polishing unit (single-side polishing apparatus 100) including a second rotating plate (rotating plate 10) having a surface provided with a second polishing pad (polishing pad 12), and a second polishing head (polishing head 20); while a second polishing solution is supplied to the second polishing pad (polishing pad 12), the second rotating plate (rotating plate 10) and the silicon wafer W are rotated with the silicon wafer W held by the second polishing head (polishing head 20) being attached to the second polishing pad (polishing pad 12), thereby further polishing the surface of the silicon wafer W.

Here, the finish polishing step (step S5) in the final polishing step includes a finish slurry polishing step (step S52) using a polishing solution having an abrasive grain density of $1\times10^{13}/cm^3$ or more as a second polishing solution; and a pre-polishing step (step S51) that is performed prior to the finish slurry polishing step (step S52) using a polishing solution having an abrasive grain density of $1\times10^{10}/cm^3$ or less as a second polishing solution.

In the finish slurry polishing step (step S52), the polishing solution is preferably alkaline, and preferably uses an alkaline aqueous solution containing water-soluble polymers and abrasive grains with a density of $5\times10^{13}/cm^3$ or less. The polishing rate of silicon using this alkaline aqueous solution is preferably 5 nm/min to 20 nm/min. A polishing rate of 5 nm/min or more does not result in a long polishing time for achieving a desired amount of polishing, thus would not deteriorate the productivity, and can have a sufficient effect to remove defects formed in the silicon wafer surface in the upstream polishing step. A polishing time of 20 nm/min or less does not result in an excessive etching effect of alkali and thus would not make the roughness of the silicon wafer surface more severe. In terms of obtaining such a polishing rate, the above alkaline aqueous solution preferably contains ammonia and preferably contains water-soluble polymers. As the water-soluble polymers, one or more selected from hydroxyethyl cellulose (HEC), polyethylene glycol (PEG), and polypropylene glycol (PPG) are preferably used. Note that the viscosity of the above alkaline aqueous solution at use temperatures (18° C. to 25° C.) is preferably 1.5 mPa·s to 5.0 mPa·s. When the viscosity is less than 1.5 mPa·s, the polishing agent would easily flow and a desired etching rate would not be obtained; on the other hand, when the viscosity is 5.0 mPa·s or more, the polishing agent would remain and stick to the silicon wafer surface even if cleaning is performed after finish polishing.

The abrasive grains used may include ceramics such as silica or alumina; diamond or silicon carbide alone or a compound thereof; a high molecular weight polymer such as polyethylene or polypropylene; and others; however, the abrasive grains preferably include $SiO_2$ particles for reasons of low cost, dispersibility in the polishing agents, for example easy control of the diameter of abrasive grains. In addition, $SiO_2$ particles used may be, for example, prepared by either a dry process (combustion process/arc process) or a wet process (sedimentation process/sol-gel process)." The abrasive grains to be used may have a spherical shape, a cocoon-like shape, or the like.

The polishing time for the finish slurry polishing step (step S52) is preferably 60 s to 900 s. A polishing time of 60 s or more allows the silicon wafer to be sufficiently polished while a polishing time of 900 s or less can prevent the silicon wafer from having a rough surface.

Next, on the other hand, in the pre-polishing step (step S51), the polishing solution is preferably neutral or alkaline and has an abrasive grain density of $1\times10^{10}/cm^3$ or less. When the polishing solution is an alkaline solution, the polishing rate for silicon is preferably 10 nm/min or less. A polishing rate of 10 nm/min or less can prevent the surface of the silicon wafer from being rough and allows the silicon wafer surface to be evenly polished. The polishing solution is preferably pure water, more preferably ultrapure water. This can prevent the silicon wafer surface from being rough. Alternatively, the polishing solution may be an alkaline solution. In the case of an alkaline solution, particles left on the polishing head (particularly on the inner wall of the retainer ring) can be more easily removed. In that case, the polishing solution preferably contains one or more alkalis selected from potassium hydroxide (KOH), sodium hydroxide (NaOH), tetramethylammonium (TMAH), and tetraethylammonium (TEAH), and may contain water-soluble polymers. In this case, the silicon wafer is protected, and the reattachment of particles and damages to the retainer ring can be prevented. When the polishing solution is pure water, the viscosity of the polishing solution at 20° C. is approximately 1 mPa·s. When the polishing solution contains water-soluble polymers, the viscosity of the polishing solution at use temperatures (18° C. to 25° C.) is preferably 5.0 mPa·s or less. Even when the viscosity exceeds 5.0 mPa·s, no more effect can be obtained and the productivity would be reduced. The kind of the abrasive grains is the same as one described for the polishing slurry used in the above finish polishing step.

The pre-polishing step (step S51) is preferably performed for 10 s to 60 s. When the step is performed for 10 s or more, the particles accumulated on the polishing pad can be more reliably removed; on the other hand, when the step is performed for 60 s or less, the silicon wafer can be prevented from having a rough surface.

The rotational speed of the second polishing head in the pre-polishing step (step S51) is preferably higher than the rotational speed of the second polishing head in the finish slurry polishing step (step S52). Specifically, the rotational speed of the second polishing head in the pre-polishing step (step S51) is preferably equal to or higher than 1.5 times the rotational speed of the second polishing head in the finish slurry polishing step (step S52). This increases the mechanical action to further improve the particle removal action.

The operation and effect of the method of polishing a silicon wafer, according to this embodiment will now be described.

The present inventors found out that particles are accumulated on the polishing head used in the finish polishing step, on the inner wall of the retainer ring in particular, and the particles cause damages to the surface of the silicon wafer in the finish polishing step, resulting in the formation of LPDs.

On the other hand, the method of polishing a silicon wafer, according to this embodiment, the finish polishing step (step S5) in the final polishing step includes the finish slurry polishing step (step S52) using a polishing solution having an abrasive grain density of $1\times10^{13}/cm^3$ or more as a second polishing solution; and the pre-polishing step (step S51) that is performed prior to the finish slurry polishing step (step S52) using a polishing solution having an abrasive grain density of $1\times10^{10}/cm^3$ or less as a second polishing solution.

Performing the pre-polishing step (step S51) prior to the finish slurry polishing step (step S52) can remove particles deposited on the polishing head for finish polishing (the inner wall of the retainer opening in particular) and can inhibit the formation of LPDs caused due to the particles.

Here, the second polishing solution used in the pre-polishing step is preferably pure water. This can prevent the surface of the silicon wafer from being rough.

Further, as described above, the pre-polishing step is preferably performed for 10 s to 60 s.

Moreover, as described above, the rotational speed of the second polishing head in the pre-polishing step is preferably higher than the rotational speed of the second polishing head in the finish slurry polishing step; particularly, the rotational speed of the second polishing head in the pre-polishing step is preferably equal to or higher than 1.5 times the rotational speed of the second polishing head in the finish slurry polishing step.

(Method of Producing Silicon Wafer)

In a method of producing a silicon wafer, according to one embodiment of this disclosure, first, a single crystal silicon ingot grown by the Czochralski process is sliced to obtain a silicon wafer to be polished. The growing of the single crystal ingot and the slicing step can be performed in the like manner as in existing techniques.

After that, the obtained silicon wafer to be polished is subjected to polishing of the method of polishing a silicon wafer, according to the embodiment described above.

Thus, the like mechanism as described above can remove particles deposited on the polishing head for finish polishing (the inner wall of the retainer opening in particular) and can inhibit the formation of LPDs caused due to the particles.

EXAMPLES

Examples of this disclosure will now be described; however, this disclosure is not limited to the Examples in any way.

To verify the effect of the polishing method of this disclosure, silicon wafers were polished by methods of Example and Conventional Examples 1 and 2, and the number of LPDs was checked, thus, evaluation tests were performed. In Example and Conventional Examples 1 and 2, for the silicon wafers, p-type silicon wafers with a diameter of 300 mm and a crystal plane orientation (100) were used. The polishing apparatus used was one as depicted in FIG. 2.

Example 1

Having undergone steps up to upstream polishing, the silicon wafers were subjected to a pre-polishing step, followed by a finish polishing step. After that, the silicon wafers were cleaned and LPDs were counted.

In the pre-polishing step, pure water free of abrasive grains was used as a polishing solution. The polishing time was 30 s, and the rotational speed of the polishing head was set to twice the rotational speed in the finish polishing step.

In the finish polishing step, an alkaline aqueous solution that had an abrasive grain density of $5\times10^{13}/cm^3$ and used $SiO_2$ as abrasive grains was used as a polishing slurry. The polishing time was 180 s.

The counting of LPDs was performed by checking the number of LPDs having a size of 35 nm or more using Surfscan SP5 manufactured by KLA-Tencor Corporation in a measurement mode of DCN. This was performed on four silicon wafers, and the average of the number of LPDs was calculated.

Conventional Example 1

Polishing was carried out by the same method as in Example 1 except that the pre-polishing step was not performed.

Conventional Example 2

Polishing was carried out by the same method as in Example 1 except that polishing was not performed after the upstream polishing step before the finish polishing step; and the same polishing step as the pre-polishing step in Example 1 was performed after the finish polishing step.

Figure 3:
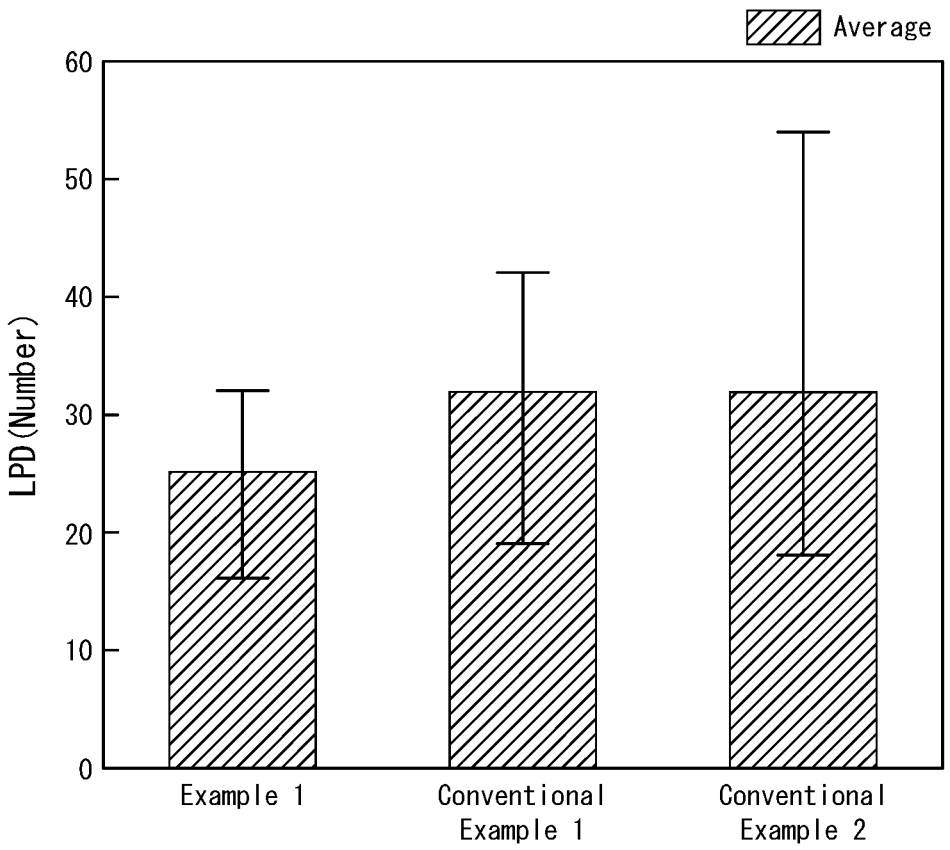
FIG. 3 is a diagram illustrating the evaluation results of Examples.

The evaluation results are given in FIG. 3. FIG. 3 demonstrates that the LPDs were reduced more in Example 1 than in Conventional Examples 1 and 2.

REFERENCE SIGNS LIST

100: Single-side polishing apparatus
10: Rotating plate
12: Polishing pad
14: Plate rotating shaft
20: Polishing head
22: Backing pad
24: Retainer ring
26: Shaft
28: Rotation frame
30: Slurry supply
32: Polishing slurry
W: Silicon wafer

The invention claimed is:

1. A method of polishing a silicon wafer, comprising a final polishing process including:

an upstream polishing process, using an upstream polishing unit including a first plate provided with a first polishing pad and a first polishing head, of polishing a surface of a silicon wafer by rotating the first plate and the silicon wafer held by the first polishing head with the silicon wafer being attached to the first polishing pad while supplying a first polishing agent to the first polishing pad; and a subsequent finish polishing process, using a finish polishing unit including a second plate provided with a second polishing pad and a second polishing head, of further polishing the surface of the silicon wafer by rotating the second plate and the silicon wafer held by the second polishing head with the silicon wafer being attached to the second polishing pad while supplying a second polishing agent to the second polishing pad, wherein the finish polishing process in the final polishing process includes:

a finish slurry polishing process using a polishing solution having an abrasive grain density of $1\times10^{13}/cm^3$ or more as the second solution agent; and a pre-polishing process using a solution having an abrasive grain density of $1\times10^{10}/cm^3$ or less as the second solution agent, the pre-polishing process being performed prior to the finish slurry polishing process.

2. The method of polishing a silicon wafer, according to claim 1, wherein the second solution agent used in the pre-polishing process is pure water.

3. The method of polishing a silicon wafer, according to claim 1, wherein the pre-polishing process is performed for 10 s to 60 s.

4. The method of polishing a silicon wafer, according to claim 1, wherein a rotational speed of the second polishing head in the pre-polishing process is higher than a rotational speed of the second polishing head in the finish slurry polishing process.

5. The method of polishing a silicon wafer, according to claim 4, wherein the rotational speed of the second polishing head in the pre-polishing process is equal to or higher than 1.5 times the rotational speed of the second polishing head in the finish slurry polishing process.

6. A method of producing a silicon wafer, comprising:

slicing a single crystal silicon ingot grown by the Czochralski process to obtain a silicon wafer to be polished; and then subjecting the resulting silicon wafer to be polished to the method of polishing a silicon wafer, according to claim 1.

* * * * *